US005152562A

United States Patent [19]

Stevenson et al.

[11] Patent Number: 5,152,562

[45] Date of Patent: Oct. 6, 1992

[54] SHOCK-ACTUATED LOCK WITH RESETTABLE BALL

[76] Inventors: John M. Stevenson, 3413 Alginet Dr., Encino, Calif. 91436; James M. Simpson, 547 Weybridge Dr., San Jose, Calif. 95123

[21] Appl. No.: 787,831

[22] Filed: Nov. 5, 1991

[51] Int. Cl.[5] ..... E05C 19/04

[52] U.S. Cl. ..... 292/252; 292/DIG. 65; 292/DIG. 22

[58] Field of Search ..... 292/252, DIG. 22, DIG. 65

[56] References Cited

U.S. PATENT DOCUMENTS

| | | | |
|---|---|---|---|
| 2,215,044 | 9/1940 | Kammerdiner | 137/139 |
| 2,585,316 | 2/1952 | Hobson | 137/139 |
| 2,659,228 | 11/1953 | Ducharme | 70/20 |
| 2,693,615 | 11/1954 | Hatke | 16/83 |
| 3,799,596 | 3/1974 | Nozomu et al. | 292/DIG. 22 |
| 3,828,899 | 8/1974 | Scott | 292/231 |
| 4,536,021 | 8/1985 | Mochida | 292/DIG. 22 |
| 4,552,399 | 11/1985 | Atarashi | 292/DIG. 22 |
| 4,652,029 | 3/1987 | Yamamoto | 292/252 |
| 4,714,286 | 12/1987 | Yamamoto | 292/252 |
| 4,865,368 | 9/1989 | McCall et al. | 292/252 |
| 4,906,044 | 3/1990 | Wilstermann | 292/252 |
| 4,988,134 | 1/1991 | Vidwans et al. | 292/DIG. 22 |
| 5,035,451 | 7/1991 | Brady | 292/DIG. 22 |

FOREIGN PATENT DOCUMENTS

| | | | |
|---|---|---|---|
| 2946095 | 5/1981 | Fed. Rep. of Germany | 292/DIG. 22 |
| 326901 | 8/1970 | Sweden | 292/231 |
| 19883 | of 1895 | United Kingdom | 292/252 |

OTHER PUBLICATIONS

Popular Science Article, "Wizard's Boxes", pp. 188–191, Mar. 1953.

*Primary Examiner*—Eric K. Nicholson

*Attorney, Agent, or Firm*—Rosenblum, Parish & Isaacs

[57] ABSTRACT

A shock-activated lock for attachment to a cabinet that prevents the cabinet door from opening in the event of an earthquake. The lock includes a slotted engaging member attached to the cabinet door, and a lock housing attached to the cabinet frame that contains a ball that normally rests on a raised shelf. The engaging member extends into the housing when the door is closed. In the event of an earthquake, the ball falls into the slot in the engaging member, preventing the engaging member from withdrawing from the housing, thus preventing the cabinet door from opening.

10 Claims, 3 Drawing Sheets

SHOCK-ACTUATED LOCK WITH RESETTABLE BALL

BACKGROUND OF THE INVENTION

1. Field of the Invention

This invention relates generally to locking devices, and more particularly to a shock-activated locking device adapted for preventing cabinets from opening during an earthquake or other severe vibrational shock.

2. Brief Description of the Prior Art

Various mechanisms have been developed over the years for the purpose of locking the doors of cabinets. A typical mechanism consists of a magnetic fastener that yields when the door is pulled with sufficient force. Such a mechanism commonly opens during an earthquake or other severe vibrational shock, allowing the cabinet's contents to fall out of the cabinet.

Other mechanisms for locking cabinets consist of common locks or latches that are manually actuated, with or without a key. Such mechanisms are inconvenient for cabinets that are opened and closed frequently, as the latch must be manually disengaged every time the cabinet door is opened.

Vibration-activated valves, such as Kammerdiner, U.S. Pat. No. 2,215,044 and Hobson, U.S. Pat. No. 2,585,316, disclose automatic shutoff valves that stop gas or fluid flow in pipes in the event of an earthquake or other shock. The operation of these devices consists of a ball that falls into the valve housing when the valve is subjected to a shock. The pressure of the fluid flow then causes the ball to seal against its seat, thereby shutting off the flow.

SUMMARY OF THE INVENTION

It is a primary objective of the present invention to provide a shock-actuated locking device that normally permits a cabinet door to open freely, but which will lock in the event of an earthquake or other severe shock, preventing the cabinet door from opening.

Another object of the present invention is to provide a shock-actuated locking mechanism that provides a simple, convenient method of resetting to the unlocked state after an earthquake or other severe shock.

Briefly, the preferred embodiment of the present invention comprises a lock housing mounted to an internal surface of a cabinet, and a slotted engaging member mounted to the interior side of a cabinet door. The lock housing has an aperture located such that the engaging member extends into the aperture of the housing when the cabinet door is closed. Inside the lock housing, a ball normally rests in a shallow cavity above the aperture in the housing and the slot in the engaging member. In the event of a severe shock to the enclosure (such as an earthquake), the ball is jolted out of the cavity and into the slot of the engaging member. The ball and the aperture in the housing are shaped or sized such that the presence of the ball in the slot of the engaging member prevents the engaging member from withdrawing from the enclosure, and thus "locks" the cabinet door, preventing it from opening.

The present invention provides a convenient and inexpensive device for preventing the opening of cabinet doors during an earthquake or other severe shock, thereby eliminating expensive damage and dangerous and messy breakage. In addition, although the invention has been described in terms of its application to cabinets, it is clearly suited to any application in which it is desirable to prevent two objects from separating during an earthquake.

These and other objects and advantages of the present invention will no doubt become apparent to those skilled in the art after having read the following detailed description of the preferred embodiment which is contained in and illustrated by the various drawing figures.

IN THE DRAWINGS

FIG. 1 is a cut-away side view of the interior of the preferred embodiment of this invention: and FIG. 2 is a top view of the interior of the preferred embodiment of this invention; and FIG. 3 is a cut-away side view of the interior of an alternate embodiment of this invention.

DETAILED DESCRIPTION OF THE PREFERRED EMBODIMENT

This invention comprises a lock that is actuated by a severe shock. Although the invention is described below with specific reference to its use as a cabinet door lock, it is suited for use in any number of different applications where it would be advantageous to prevent two objects from separating in the event of a severe shock.

Figure 1:
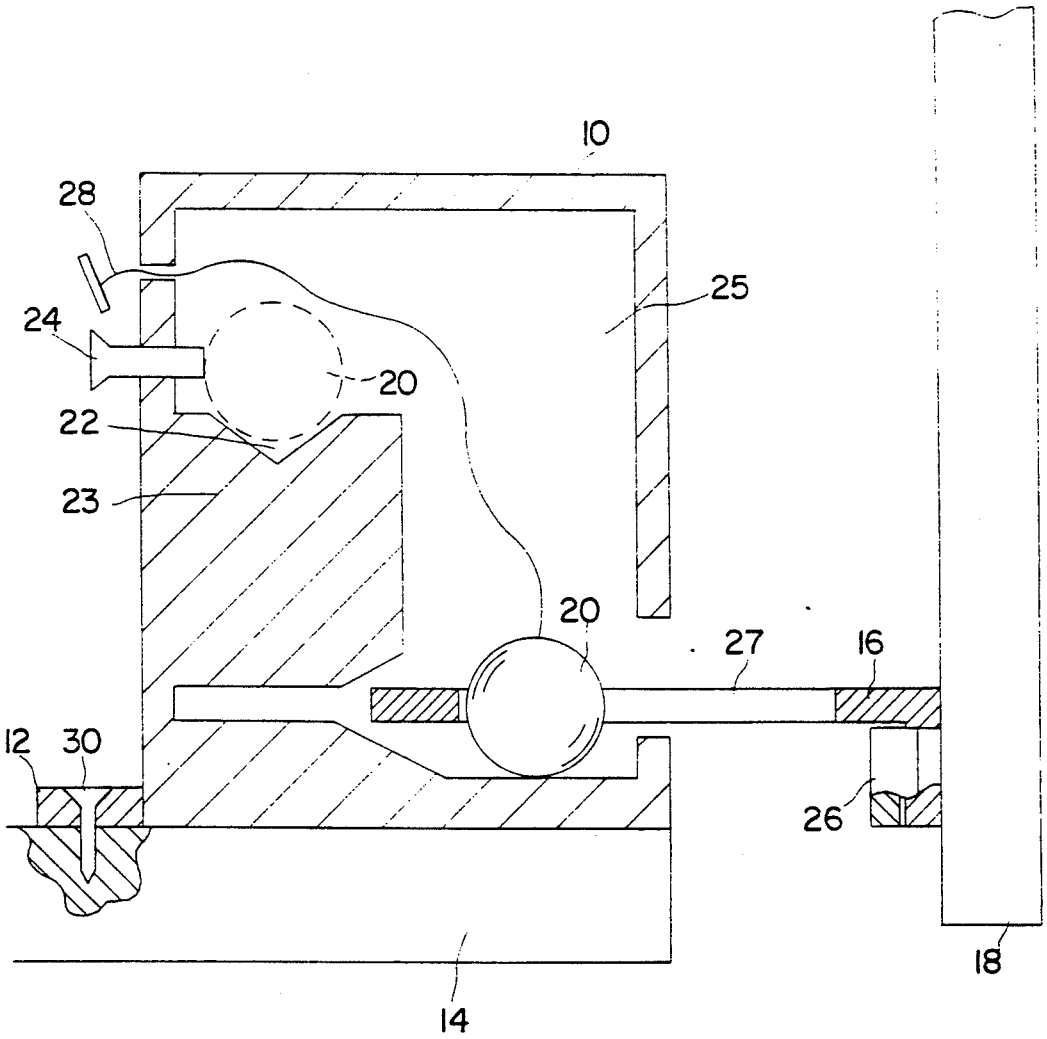
Figure 2:
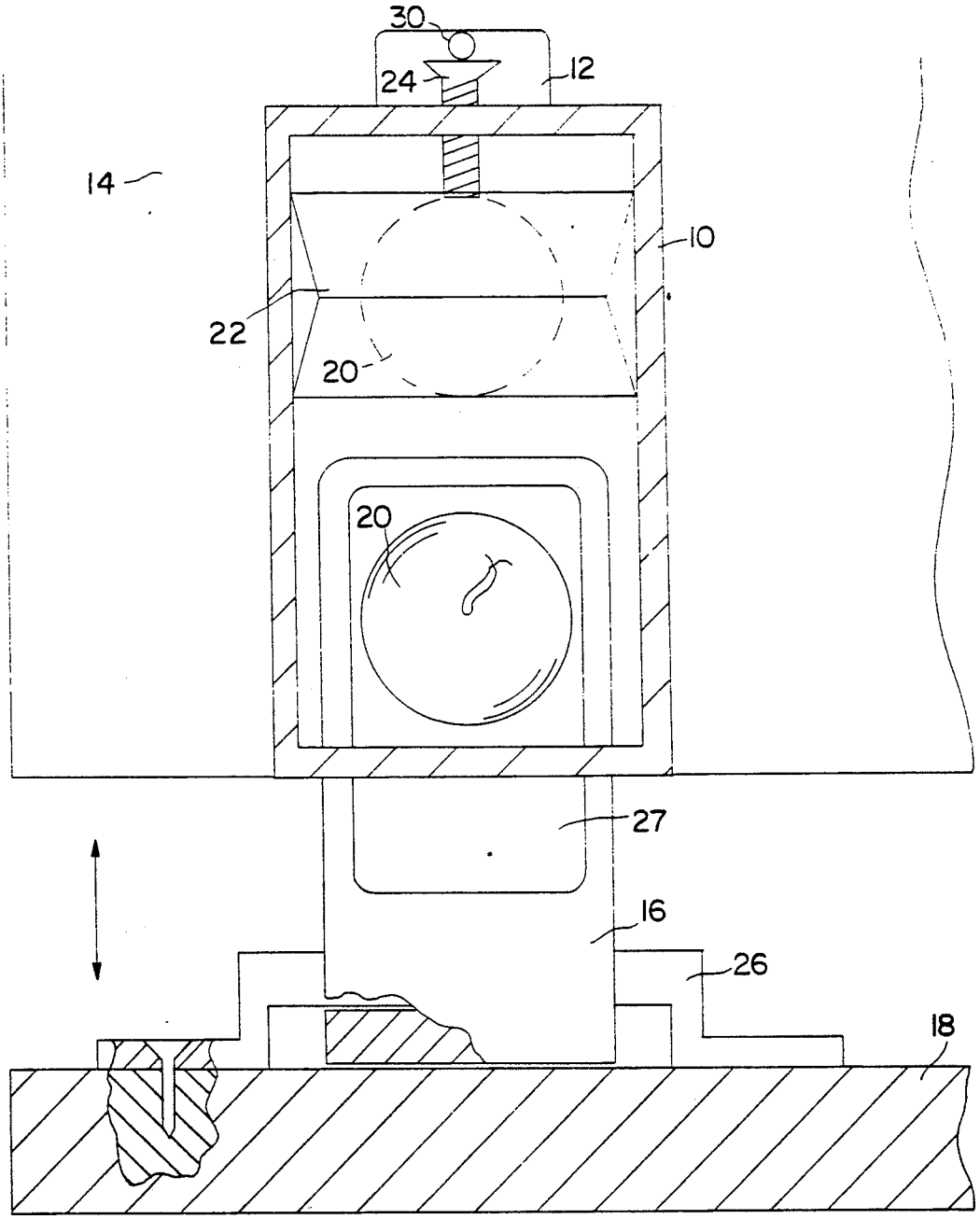

Referring now to FIGS. 1 and 2 of the drawing, a generally rectangular, box-shaped lock housing 10 is mounted to an internal surface of a cabinet 14 with screw 30 through mounting tab 12. A slotted engaging member 16 is demountably attached to the interior side of a cabinet door 18 with bracket 26.

Inside the lock housing, a ball 20 normally rests in a shallow cavity 22 on a shelf 23 above an hollow passage 25 in housing 10 and a slot 27 in engaging member 16. In the event of a severe shock to the device (such as an earthquake), ball 20 is jolted out of the cavity 22 on shelf 23, and falls down passage 25 into slot 27 of engaging member 16. Ball 20 is of sufficient size that its presence in slot 27 of engaging member 16 prevents the engaging member from withdrawing from housing 10, thus preventing cabinet door 18 from opening.

The preferred embodiment of the invention also includes means to adjust the sensitivity of the device to shock. FIGS. 1 and 2 show sensitivity adjustment screw 24 which may be used to modify the depth in cavity 22 where ball 20 normally rests. This feature allows the user to adjust the severity of the shock necessary to actuate the lock.

The preferred embodiment further utilizes a resetting means to allow the user to open the cabinet door and reset the device to the normal, unlocked position after a shock has occurred. FIGS. 1 and 2 show that engaging member 16 is connected to the cabinet door 18 with a bracket 26. Engaging member 16 is demountable from cabinet door 18 and bracket 26 by upward force on the member, allowing door 18 to open. Cord 28 connected to ball 20 extends out of the back of housing 10, allowing the ball to be pulled back into cavity 22. These features provide a simple and convenient means for opening the cabinet door and resetting the locking device after a shock. Of course, the door-opening and resetting means may also use alternative designs, such as a button and spring latch or a strong magnet as a release for the engaging member 16 or a lever for resetting the ball to its position in cavity 22. After ball 20 has been lifted from slot 27, engaging member 16 may be reattached to bracket 26.

Figure 3:
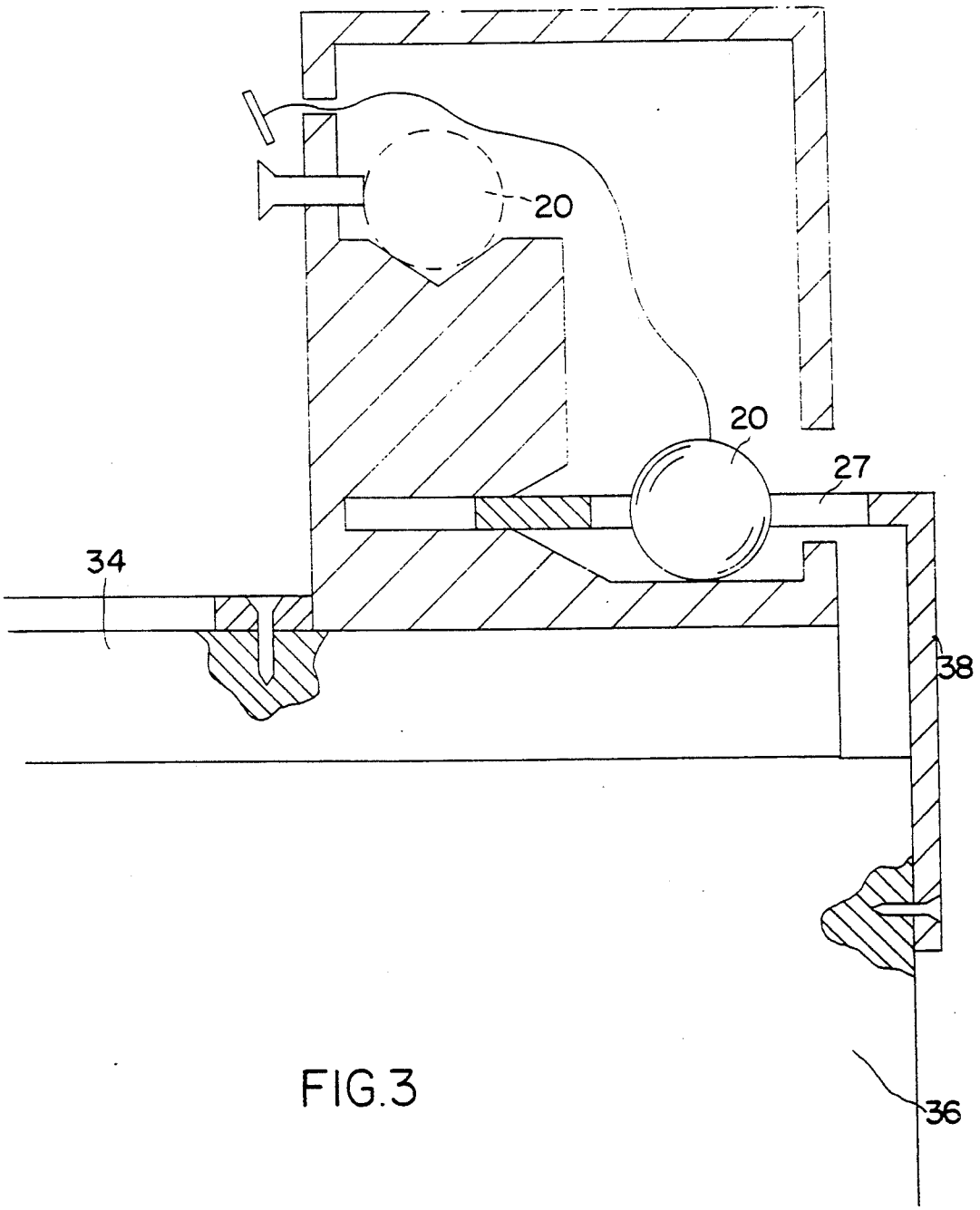

FIG. 3 depicts an alternate embodiment of the present invention adapted to securing an upper object 34 to a lower object 36 when the objects are stacked vertically. In this embodiment, the engaging member 38 is L-shaped, and one end is mounted vertically to the lower object. The other end has a slot 27, as in the previous embodiment, and the upper object 34 is normally freely movable by sliding it away from the engaging member 38. In the event of an earthquake, the presence of the ball 20 in the slot 27 secures the objects together, thus preventing the upper object 34 from falling off of the lower object 36.

Although the present invention has been described above in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A shock-actuated locking mechanism, comprising:

a lock housing mountable to a surface of a first object;

an engaging member mountable to a surface of a second object, wherein said engaging member may enter and exit said locking housing when said mechanism is unlocked;

latching means for locking said lock housing to said engaging member, wherein said latching means comprises a locking piece, supporting means attached to said lock housing for supporting said locking piece in an upper unlatched position when said mechanism is unlocked, and an aperture in said engaging member for receiving said locking piece when said latching means is activated by a vibrational shock, such vibrational shock causing said locking piece to fall from said upper unlatched position to be received by said aperture at a lower latched position, thereby locking said lock housing and said engaging member together and preventing separation of said lock housing and said engaging member; and resetting means for resetting said latching means to its unlocked position.

2. The mechanism of claim 1, further comprising sensitivity adjustment means for adjusting the sensitivity of the locking mechanism to vibrational shocks of different intensity.

3. The mechanism of claim 1, further comprising releasing means independent of said resetting means for disengaging said first and second objects.

4. The mechanism of claim 2, further comprising releasing means independent of said resetting means for disengaging said first and second objects.

5. A shock-actuated locking mechanism, comprising:

a lock housing mountable to a surface of a first object;

an engaging member mountable to a surface of a second object, wherein said engaging member may enter and exit said lock housing when said mechanism is unlocked;

latching means for locking said lock housing to said engaging member, said latching means activated by vibrational shock, whereby said lock housing and said engaging member are locked together to prevent separation of said lock housing and said engaging member, said latching means comprising (a) a ball, (b) a shelf attached to said lock housing and having a shallow concave pocket in which said ball rests when said mechanism is unlocked, and (c) an aperture in said engaging member where said ball lies after said ball is dislodged by a vibrational shock; and resetting means for resetting said latching means to its unlocked position.

6. The mechanism of claim 5, further comprising releasing means independent of said resetting means for disengaging said first and second objects.

7. The mechanism of claim 6, further comprising sensitivity adjustment means for adjusting the sensitivity of the locking mechanism to vibrational shocks of different intensity.

8. The mechanism of claim 7, wherein said sensitivity adjustment means comprises means for adjusting the depth of the pocket in which said ball rests.

9. The mechanism of claim 8, wherein said sensitivity adjustment means comprises a screw.

10. The mechanism of claim 5, further comprising sensitivity adjustment means for adjusting the sensitivity of the locking mechanism to vibrational shocks of different intensity.

* * * * *